United States Patent [19]

Rambousek et al.

[11] Patent Number: 4,651,784

[45] Date of Patent: Mar. 24, 1987

[54] PLAIN WEAVE SHEDDING MECHANISM

[75] Inventors: Zdenek Rambousek; Jiri Zlatohlavek, both of Liberec, Czechoslovakia

[73] Assignee: ELITEX, koncern textilniho, Liberec, Czechoslovakia

[21] Appl. No.: 624,988

[22] Filed: Jun. 27, 1984

[30] Foreign Application Priority Data

Jun. 27, 1983 [CS] Czechoslovakia ..... 4738-83

[51] Int. Cl.[4] ..... D03C 13/00

[52] U.S. Cl. ..... 139/57

[58] Field of Search ..... 139/57, 58, 82, 55.1, 139/83, 29, 30, 31, 79, 80, 81

[56] References Cited

U.S. PATENT DOCUMENTS

| | | | |
|---|---|---|---|
| 2,980,145 | 4/1961 | Herard, Jr. et al. | 139/80 |
| 3,168,166 | 2/1965 | Krenz | 139/57 |
| 4,041,986 | 8/1977 | Resch | 139/58 |
| 4,151,866 | 5/1979 | Gloor | 139/29 |
| 4,314,588 | 2/1982 | Speich | 139/82 |

FOREIGN PATENT DOCUMENTS

| | | | |
|---|---|---|---|
| 1091949 | 3/1958 | Fed. Rep. of Germany | 139/57 |
| 788550 | 10/1935 | France | 139/81 |
| 902617 | 9/1945 | France | 139/57 |
| 1015605 | 10/1952 | France | 139/57 |
| 1160622 | 7/1958 | France | 139/57 |
| 619766 | 4/1961 | Italy | 139/81 |
| 837 | of 1864 | United Kingdom | 139/57 |
| 18071 | of 1908 | United Kingdom | 137/57 |

*Primary Examiner*—Werner H. Schroeder
*Assistant Examiner*—Joseph S. Machuga

[57] ABSTRACT

Plain weave shedding mechanism. Heald shafts of the mechanism are connected by connecting links to arms of adjacent balance levers in such manner that odd heald shafts are connected to one set of arms and even heald shafts are connected to the other arms, the even number arms extending in a direction opposite that of the odd numbered arms relative to the axis of rotation of the adjacent balance levers. The shedding mechanism of the invention is suitable for use as a special device for modern high speed looms when weaving plain weave fabrics.

9 Claims, 6 Drawing Figures

PLAIN WEAVE SHEDDING MECHANISM

This invention relates to a plain weave shedding mechanism suitable for uses as a special device for modern high speed looms when weaving plain weave fabrics.

In most of the known shedding mechanisms for looms, each heald shaft of the harness possesses a control mechanism of its own. This is a conventional arrangement, since when a warp shed is formed, the strokes of the heald shafts are successively increased in length, starting from the front side of the loom, so that all of the warp ends will form a warp shed having a uniform opening angle. Each heald shaft is driven by its own eccentric or cam.

When cams are used for this purpose, sheds can also be formed for other simple weaves. However, a considerable quantity of fabrics are woven in plain weave. In this event, the universal capability of the shedding mechanism remains idle and the cost of it unjustified; such mechanism makes higher demands upon adjustments and maintenance which thus reduces its service life. It also restricts the speed of the loom and constitutes a source of soiling of the fabric woven by the loom.

The aforesaid disadvantages and shortcomings of the prior art are overcome by the mechanism of the invention. In accordance with the invention, the heald shafts are connected, by connecting links, to arms of adjacent balance levers in such manner that odd heald shafts are connected to one of the arms and even heald shafts are connected to the other of the arms, said arms extending in opposite directions to the axis of rotation of the adjacent balance levers.

With respect to the necessity of maintaining a given angle of the warp shed, it has proved advantageous when the lengths of the arms of the adjacent balance levers increase towards the back heald shafts. With respect to the disposition of the drive, it has proved advantageous when each adjacent balance lever has an auxiliary arm, said auxiliary arms of the adjacent balance levers being interconnected by means of a tie rod, and also when one of the adjacent balance levers is provided with an additional arm, a connecting rod of a crank or a tie rod of a cam mechanism being connected thereto.

With regard to the disposition of the drive, it is also proved advantageous when the adjacent balance levers are provided with auxiliary arms connected by tie rods to a common two-throw crank. However, in this case, it is necessary to dispose the adjacent levers in a mirror-symmetry arrangement. Also, with respect to the disposition of the drive, it has proved advantageous when the adjacent balance levers are provided with auxiliary arm connected by tie rods to cranks rotating in opposite directions and driven by a pair of gears meshing with each other; in this case it is necessary that the adjacent balance levers be disposed in a mirror-symmetry arrangement.

Other advantages and features of the present invention will become apparent from the following description of preferred embodiments, given by way of example, illustrated in the accompanying drawings, in which.

Figure 5:
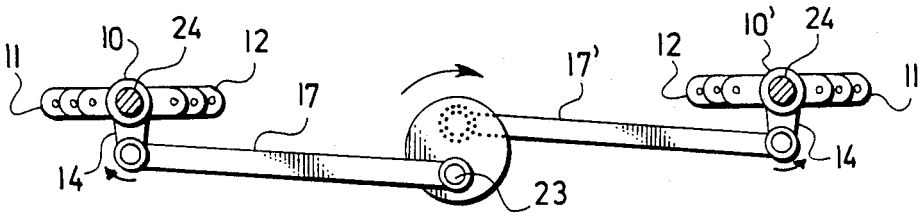
Figure 6:
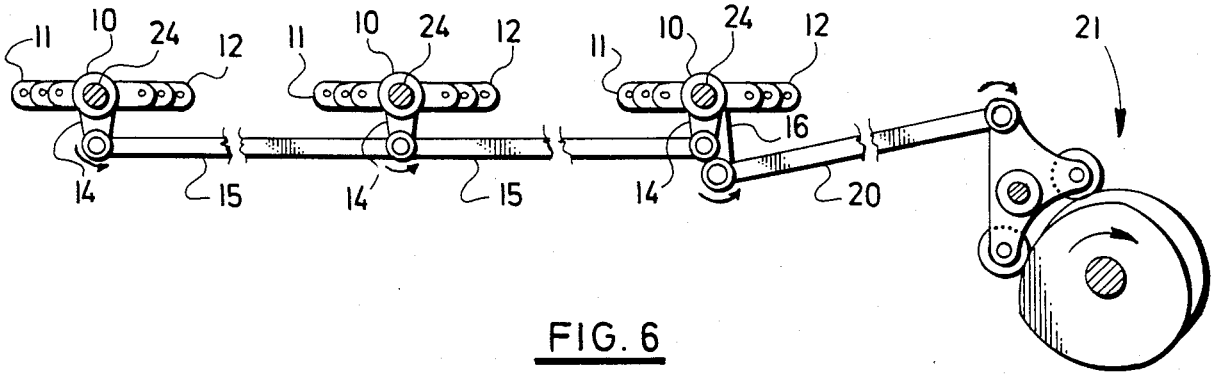

FIG. 5 is a fragmentary view partially in transverse vertical section and partially in front elevation of a fourth embodiment of shedding mechanism in accordance with the invention, said mechanism being provided with a direct drive for adjacent levers, said drive being derived from a two-throw crank; and FIG. 6 is a schematic view partially in vertical transverse section and partially in front elevation of a fifth embodiment of shedding mechanism in accordance with the invention, said shedding mechanism being adapted for use with looms having an increased width, the mechanism having a laterally disposed drive derived from a cam mechanism.

In describing each of the embodiments of the mechanism of the inventions schematically shown in the drawings, it will be assumed that the number of heald shafts in each embodiment is six. However, it would be possible to use two, four and possibly eight heald shafts. This depends upon the setting of the warp. For a dense setting, the warp ends are divided into a greater number of heald shafts, even for plain weave. The heald shafts themselves, designated 7, have been shown only in FIG. 1.

Figure 1:
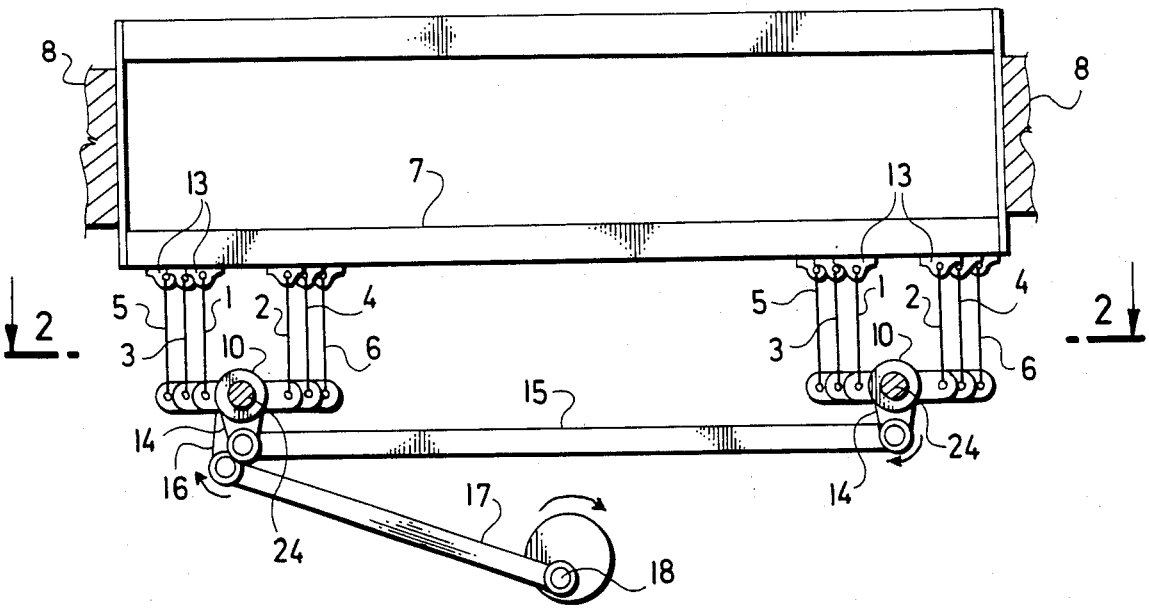
FIG. 1 is a view partially in vertical transfer section and partially in front elevation of a first embodiment of shedding mechanism in accordance with the invention, said mechanism being provided with heald shafts and a crank drive.
Figure 2:
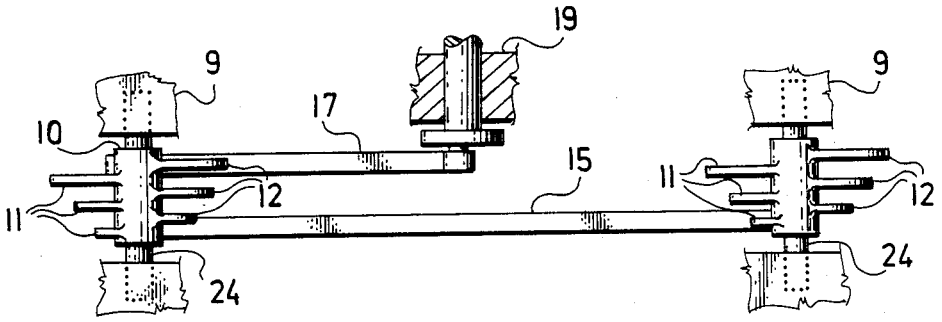
FIG. 2 is a schematic view in plan of the mechanism shown in FIG. 1.

Turning first to the embodiment shown in FIGS. 1 and 2 of the drawings, heald shafts 7 are mounted in a loom in guides 8 and are provided with lugs 13 on their lower sides. Lugs 13 are connected by connecting links 1 through 6 incl., to arms 11 on the one hand and 12 on the other of adjacent balance levers 10, 10' which are supported in a frame 9 of the loom by means of stub shafts 24. The odd heald shafts 7 are connected to arms 11, and even heald shafts 7 are connected to arms 12, said arms 11 and 12 are extending in opposite directions relative to the axis of rotation of the adjacent balance levers 10, 10'. A linkage of movement of the heald shafts 7 is thereby determined in such manner that when the odd heald shafts 7 are raised, the even heald shafts 7 are lowered, and vice versa.

In FIGS. 1 and 2 it can be seen that the lengths of the arms 11, and 12 of the adjacent balance levers 10, 10' increase towards the back heald shafts 7 so as to maintain the required angle of the warp shed. To obtain a linkage of movements, the adjacent balance levers 10, 10' have auxiliary arms 14, said arms 14 of the adjacent balance levers 10, 10' being interconnected by a tie rod 15. One of the conjugate balance levers 10, 10' is provided with an additional arm 16. A driving mechanism consisting of a connecting rod 17 and a crank 18 is connected to additional arm 16, the crank being mounted in a frame of the loom in a support 19.

Figure 3:
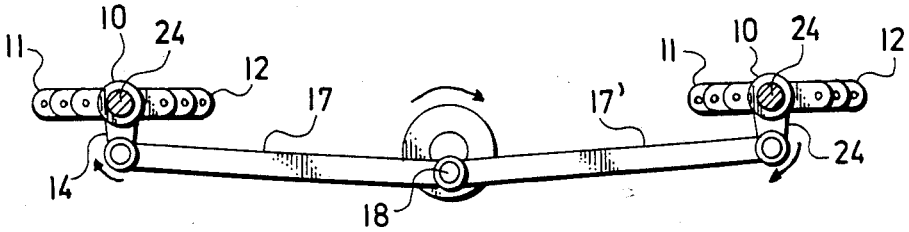
FIG. 3 is a fragmentary view partially in vertical transverse section and partially in front elevation of a second embodiment of shedding mechanism in accordance with the invention, said mechanism being provided with a direct drive of adjacent levers, said drive being derived from a crank.

In the second embodiment, shown in FIG. 3, the adjacent balance lever is 10, 10' are provided with auxiliary arms 14 directly connected, by connecting rods 17, 17', to a common crank 18. Otherwise, the arrangement shown in FIG. 3 is similar to that of the first embodiment, shown in FIGS. 1 and 2.

Figure 4:
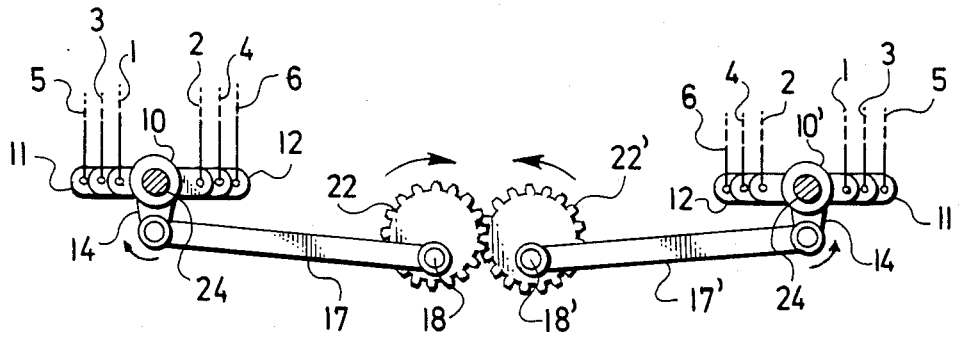
FIG. 4 is a schematic view in front elevation of a third embodiment of shedding mechanism in accordance with the invention, said mechanism being provided with a direct drive for adjacent levers, said drive being derived from two cranks.

FIG. 4 shows another disposition of the drive, wherein the adjacent balance levers 10, 10' are provided with auxiliary arms 14 connected, by the connecting rods 17, 17', to cranks 18, 18' rotating in opposite directions and driven by a pair of meshing gears 22, 22', the adjacent balance levers 10, 10' being disposed in a mirror-symmetry arrangement.

The fourth embodiment of the drive mechanism, as shown in FIG. 5, is similar to that of FIG. 4 with the exception that instead of the two cranks 18, and 18' connected by meshing gears 22, 22' of FIG. 4 there is employed a single, two-throw crank 23. In this embodiment it is also necessary to dispose the adjacent balance levers 10, 10' in a mirror-symmetry arrangement.

In the fifth illustrated embodiment of the mechanism of the invention, as shown in FIG. 6, a cam driving mechanism 21, which is disposed laterally of the loom, is connected by tie rod 20 to the arm 16. The drive effected by the cam mechanism 21 permitss weaving of derived plain weaves, such as a hopsack weave or a diagonal rep weave.

The manner of operation of the mechanisms of each of the five disclosed embodiments of the invention is apparent from the above description and from the drawings. However, by way of summary, it can be seen in the drawings that the connections of the heald shafts 7 to the adjacent balance lever 10, 10' by means of the connecting links 1 through 6 incl., are spaced apart according to the lengths of the corresponding arms 11, 12 of the adjacent balance levers 10, 10' thus the lugs 13 of the heald shafts 7 must occupy their specific positions on each heald shafts 7. In FIGS. 1, 3, and 6 it can be seen that the spacings of the connecting links 1 through 6 incl., are asymmetric, since the adjacent balance levers 10, 10', perform movements in the same direction, whereas in FIGS. 4 and 5 the links are spaced symmetrically since the adjacent balance levers 10, 10' perform movements in opposite directions. When the heald shaft 7 are transferred into the looms, the connecting links 1 through 6 incl., are more easily accessible; however, the main asset of the mechanism of the invention resides in the fact that, due to the linkage of movements of the heald shafts 7 via the adjacent balance levers 10, 10', the heald shaft are almost balanced except for a small difference; this is due to the fact that the heald shaft which is connected to the shorter arm 11 of the adjacent balance levers 10, 10', is always shorter than the following even heald shaft which is connected to the arm 12. The tie rods 15, 20, or the connecting rods transmit reduced forces into the driving mechanism.

Drives of shedding mechanisms effected by means of crank mechanisms are endowed, from the point of view of kinematics, with minor shortcomings which can be neglected in practice. The most suitable drive is by a cam mechanism, wherein it is possible to chose an optimum dependence of strokes with respect to both quiet running of the device and gentle handling of warps ends.

A further advantage of the invention resides in a substantial reduction of the number of rotation joints, which permits the use of shielded antifriction bearings. Due to a reduction of the number of movable parts, the total weight of the movable parts is reduced. Due to all of this, the quality of the device is substantially increased, and higher outputs and operating reliability are achieved therewith with accompanying reduced maintenance costs.

Although the invention is described and illustrated with reference to a plurality of embodiments thereof, it is to be expressly understood that it is in no way limited to the disclosure of such preferred embodiment but is capable of numerous modifications within the scope of the appended claims.

We claim:

1. A shedding mechanism for a plain weaving loom, said shedding mechanism comprising heald shafts and adjacent balance levers each of said adjacent balance levers is provided with two sets of arms said adjacent balance levers being connected to the heald shafts in such manner that the arms of the adjacent balance levers are connected to both off heald shafts and the even heald shafts, one set of arms of the adjacent balanced levers extending in one direction relative to the axis of rotation of the adjacent balance levers, the other set of arms of the adjacent balance levers extending in a direction opposite from the first set thereof relative to the axis of rotation of the adjacent levers, and means connecting the one set of arms of the adjacent balance levers to the system of even heald shafts, and means connecting the other set of arms of the adjacent balance levers to the system of odd heald shafts, the lengths of the individual arms of the adjacent balance levers increasing in the direction toward the back heald shafts.

2. A shedding mechanism as claimed in claim 1, wherein each of the adjacent balance levers has an auxiliary arm, said auxiliary arms of said adjacent balance lever being interconnected by a tie rod.

3. A shedding mechanism as claimed in claim 2, wherein one of said adjacent balance levers is provided with an additional arm which is connected to a connecting rod of a driving crank.

4. A shedding mechanism as claimed in claim 2, wherein one of said adjacent balance levers is provided with an additional arm connected by a tie rod to a driving cam mechanism.

5. A shedding mechanism as claimed in claim 1, wherein said adjacent levers are provided with auxiliary arms which are connected by connecting rods to a common driving crank.

6. A shedding mechanism as claimed in claim 1, wherein said adjacent balance levers are provided with auxiliary arms connected by connecting rods to a common two-throw crank said adjacent balance levers being exposed in a mirror-symmetry arrangement.

7. A shedding mechanism as claimed in claim 1, wherein said adjacent balance levers are provided with auxiliary arms connected by connecting rods to driving cranks rotating at opposite directions and driven by a pair of meshing gears, said adjacent balance levers being disposed in a mirror-symmetry arrangement.

8. A shedding mechanism as claimed in claim 1, wherein the means connecting the set of arms of the adjacent levers to the respective heald shafts are links.

9. A shedding mechanism as claimed in claim 1, wherein the arms of the adjacent balance levers are connected to at least two odd and two even heald shafts.

* * * * *